US007156678B2

(12) United States Patent
Feldman et al.

(10) Patent No.: US 7,156,678 B2
(45) Date of Patent: Jan. 2, 2007

(54) PRINTED CIRCUIT CONNECTOR ASSEMBLY

(75) Inventors: Steven Feldman, Cedar Park, TX (US); Kevin R. Meredith, Cedar Park, TX (US); Joseph N. Castiglione, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/101,268

(22) Filed: Apr. 7, 2005

(65) Prior Publication Data

US 2006/0228952 A1 Oct. 12, 2006

(51) Int. Cl.
*H01R 13/62* (2006.01)

(52) U.S. Cl. ..... 439/326

(58) Field of Classification Search ..... 439/326, 439/341, 495, 497, 499, 578, 352, 582
See application file for complete search history.

(56) References Cited

U.S. PATENT DOCUMENTS

| | | | | |
|---|---|---|---|---|
| 3,889,364 | A | 6/1975 | Krueger | |
| 4,449,770 | A | 5/1984 | Grabbe et al. | |
| 4,457,575 | A * | 7/1984 | Davis et al. | 439/610 |
| 4,850,882 | A | 7/1989 | Yu | |
| 4,941,837 | A * | 7/1990 | Nakamura | 439/341 |
| 4,998,884 | A | 3/1991 | Ishikawa et al. | |
| 5,415,573 | A * | 5/1995 | Chen et al. | 439/876 |
| 5,984,707 | A | 11/1999 | Kuwata | |
| 6,203,352 | B1 * | 3/2001 | Murakami et al. | 439/352 |
| 6,234,820 | B1 * | 5/2001 | Perino et al. | 439/326 |
| 6,447,321 | B1 * | 9/2002 | Perino et al. | 439/326 |
| 6,672,879 | B1 | 1/2004 | Neidich et al. | |
| 6,755,687 | B1 | 6/2004 | Ko | |
| 6,780,028 | B1 | 8/2004 | Kennedy et al. | |
| 2003/0029907 | A1 | 2/2003 | Neidich et al. | |
| 2003/0114043 | A1 | 6/2003 | Kuo | |
| 2004/0209495 | A1 | 10/2004 | Kennedy et al. | |
| 2005/0026498 | A1 * | 2/2005 | Ikeda et al. | 439/582 |
| 2005/0112928 | A1 * | 5/2005 | Funatsu | 439/326 |

FOREIGN PATENT DOCUMENTS

| | | |
|---|---|---|
| DE | 19832011 A | 2/2000 |
| EP | 0 326 350 A2 | 8/1989 |
| EP | 0396522 | 7/1990 |
| EP | 0 871 262 A2 | 10/1998 |
| JP | 07176850 | 12/1993 |
| JP | 09115575 | 10/1995 |
| JP | 08148204 | 6/1996 |
| JP | 10050430 | 2/1998 |

* cited by examiner

*Primary Examiner*—Chandrika Prasad
(74) *Attorney, Agent, or Firm*—Melanie G. Gover

(57) ABSTRACT

A connector assembly includes a connector portion and a frame. The connector portion includes a connector body, a shield member, and a plurality of signal contacts. The connector body is configured for receiving a plurality of cables. The conductive shield member is attached to the connector body and is configured for connection to ground conductors of the plurality of cables. The plurality of signal contacts each have a terminal end configured for connection to a signal conductor of a corresponding cable. The frame is configured for mounting on a printed circuit, and includes at least one conductive portion configured for connection to a ground of the printed circuit. The frame is configured to direct the connector portion into a receiving space at an oblique insertion angle with respect to the printed circuit.

39 Claims, 6 Drawing Sheets

PRINTED CIRCUIT CONNECTOR ASSEMBLY

BACKGROUND

The present invention relates to electrical connectors, and particularly to a connector assembly including a cable connector and printed circuit-mounted frame therefor.

In many electronic devices, it is desired to connect a cable, such as a coaxial or twin-axial cable, to a printed circuit. As electronic devices become smaller, less space is available for making the connection between the cable and the printed circuit. In particular, space above the surface of the printed circuit is limited. Therefore, the height of the connector as measured from the surface of the printed circuit must be small. Space is also limited on the printed circuit itself. Thus, the area occupied by the connector on the surface of the printed circuit (the "footprint" of the connector) must also be small. The footprint of the connector includes space on the printed circuit that must be kept free of surface-mounted components so as to allow engagement and disengagement of the connector.

Presently available connectors generally fall into one of two categories: vertically-mated connectors and horizontally-mated connectors. Vertically-mated connectors engage in a direction generally orthogonal to the surface of the printed circuit (commonly referred to as the Z-axis), while horizontally-mated connectors engage in a direction generally parallel to the surface of the printed circuit. Available vertically-mated connectors generally have a Z-axis height too large for use in many devices (such as mobile phones, personal digital assistants (PDAs), and digital music players, for example) where a low-profile connector is required. However, vertically-mated connectors have an advantage of a relatively small footprint on the surface of the printed circuit, because no additional space on the printed circuit is required for engagement and disengagement of the connector. In contrast, horizontally-mated connectors generally have a lower Z-axis height, but also have a larger footprint on the printed circuit due to the space on the printed circuit that must be kept free of surface-mounted components to allow engagement and disengagement of the connector. The use of horizontally-mated connectors results in loss of valuable printed circuit real estate, and typically precludes the use of horizontally-mated connectors anywhere but at the edges of the printed circuit. However, in many small electronic devices, it is desired or necessary to place the connectors at positions other than an edge of the printed circuit.

In addition to the increasingly restrictive connector height and footprint requirements imposed by small electronic devices, the requirements for improved electrical performance of such connectors are also becoming more demanding. However, providing improved electrical performance becomes more difficult as connector sizes decrease.

SUMMARY

There remains a need for a connector having a low profile and small footprint capable of providing the required electrical performance in small electronic devices.

One aspect of the invention described herein provides a connector assembly. In one embodiment according to the invention, the connector assembly comprises a connector portion and a frame. The connector portion comprises a connector body, a shield member, and a plurality of signal contacts. The connector body is configured for receiving a plurality of cables of the type having a signal conductor and a ground conductor. The conductive shield member is attached to the connector body, and is configured for connection to the ground conductors of the plurality of cables. The plurality of signal contacts each have a terminal end configured for connection to the signal conductor of a corresponding cable. The frame is configured for mounting on a printed circuit, and includes at least one conductive portion configured for connection to a ground of the printed circuit. The frame defines a space for receiving the connector portion therein, and is configured to direct the connector portion into the receiving space at an oblique insertion angle with respect to the printed circuit.

In another embodiment according to the invention, the connector assembly comprises a connector coupled to a plurality of cables, and a conductive frame. The connector comprises a dielectric connector body, a conductive shield member, and a plurality of signal contacts. The conductive shield member covers a top surface of the dielectric connector body, and is electrically connected to shields of the plurality of coaxial cables. The plurality of signal contacts are adjacent a bottom surface of the dielectric connector body, and are connected to signal conductors of the plurality of cables. The frame is mounted on a printed circuit and electrically connected to a ground of the printed circuit. The frame defines a connector receiving space with a plurality of printed circuit contact pads therein. The frame has a first guide member adjacent a front portion thereof and a second guide member adjacent a back portion thereof. The first and second guide members cooperate to direct the connector into the receiving space at an oblique insertion angle with respect to the printed circuit, such that the signal contacts of the connector contact the printed circuit contact pads with a wiping action.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the present invention is defined by the appended claims.

Figure 1:
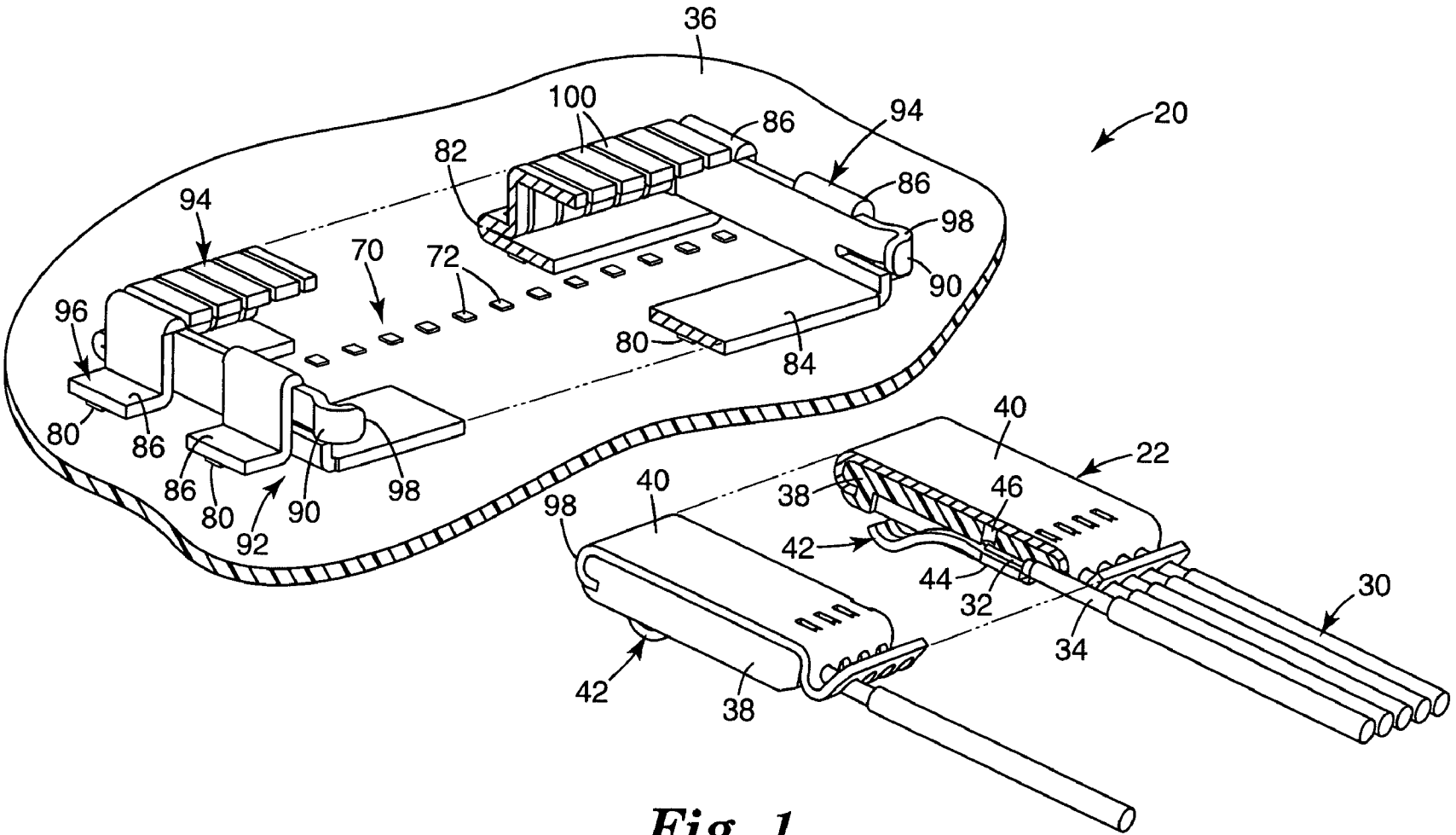
FIG. 1 is a perspective sectional view of one embodiment of a connector assembly according to the invention, the connector assembly including a connector with cables attached thereto, and a frame mounted on a printed circuit.

FIG. 1 illustrates one embodiment of a connector assembly 20 in accordance with the present invention. The connector assembly 20 includes a connector 22 and a frame 24. The connector 22 is configured for receiving one or more cables 30. The cables 30 include a signal conductor 32 and a ground conductor 34 (also referred to as a ground shield) and may be, for example, coaxial cables or twinaxial cables. The frame 24 is configured for mounting on a printed circuit 36 and receiving the connector 22 therein, such that electrical connection is made between the cables 30 and the printed circuit 36.

The connector 22 includes an electrically insulative connector body 38 having an electrically conductive shield member 40 on a top surface thereof. The shield member 40 is mounted on and secured to the connector body 38 by any suitable means, such as by insert molding, adhesive bonding, snap-fit, screws, pins, or other engagement means. The shield member 40 is configured for connection to the ground conductors 34 of the cables 30. The connector 22 further includes a plurality of signal contacts 42 on a bottom surface thereof. Each signal contact 42 has a terminal end 44 configured for connection to a signal conductor 32 of one of the plurality of cables 30.

Figure 2A:
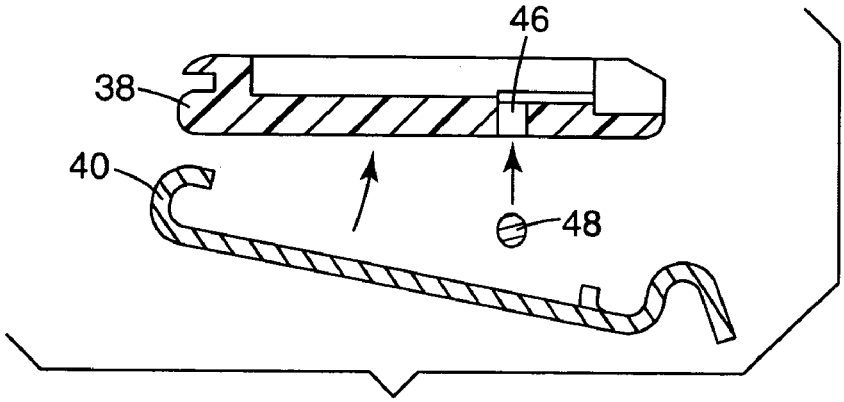
FIGS. 2A–2F are cross-sectional views illustrating assembly of the connector of FIG. 1.
Figure 2B:
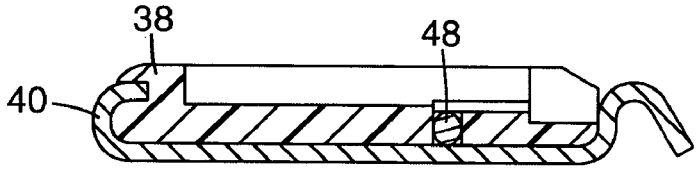
Figure 9:
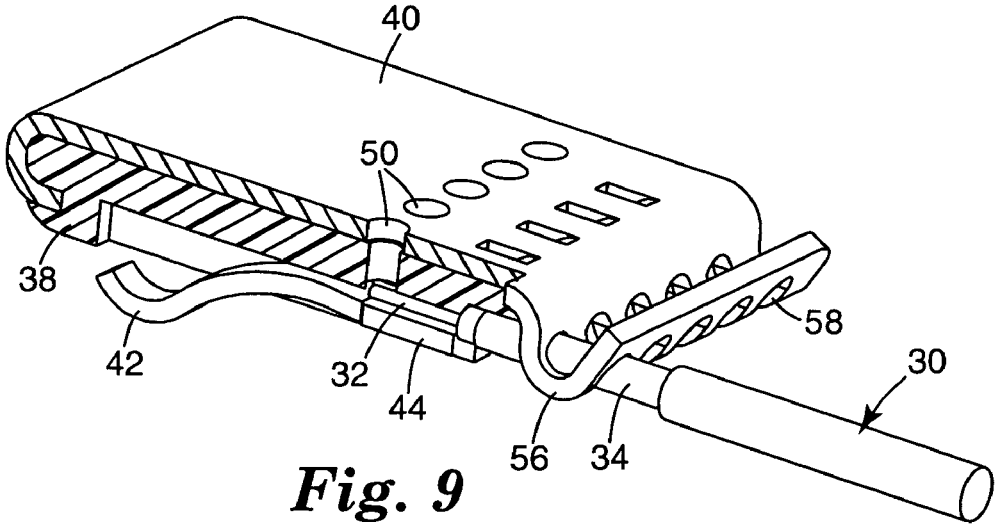
FIG. 9 is a perspective sectional view of another embodiment of a connector according to the invention.

Assembly of the connector 22 is illustrated in FIGS. 2A–2F. As best seen in FIG. 2A, the connector body 38 includes a plurality of solder wells 46. Each solder well 46 is positioned close to the eventual positions of a corresponding signal conductor 32 and a terminal end 44 of a corresponding signal contact 42. The solder wells 46 are adapted to hold solder paste or a solder preform 48 therein. A separate solder well 46 supplies each signal contact terminal end 44. As described in further detail below, the solder paste or preform 48 is used to mechanically and electrically connect the terminal ends 44 of signal contacts 42 to corresponding signal conductors 32 of the cables 30. In one embodiment, and as illustrated in FIG. 2A, the solder paste or preform 48 is inserted into the solder wells 46, and then the shield member 40 is attached to connector body 38 (FIG. 2B). In another embodiment according to the invention, the solder paste or preform 48 is dispensed into the solder well 46 through optional holes 50 in the shield member 40 (best seen in FIG. 9) after the shield member 40 is attached to the connector body 38.

Figure 2C:
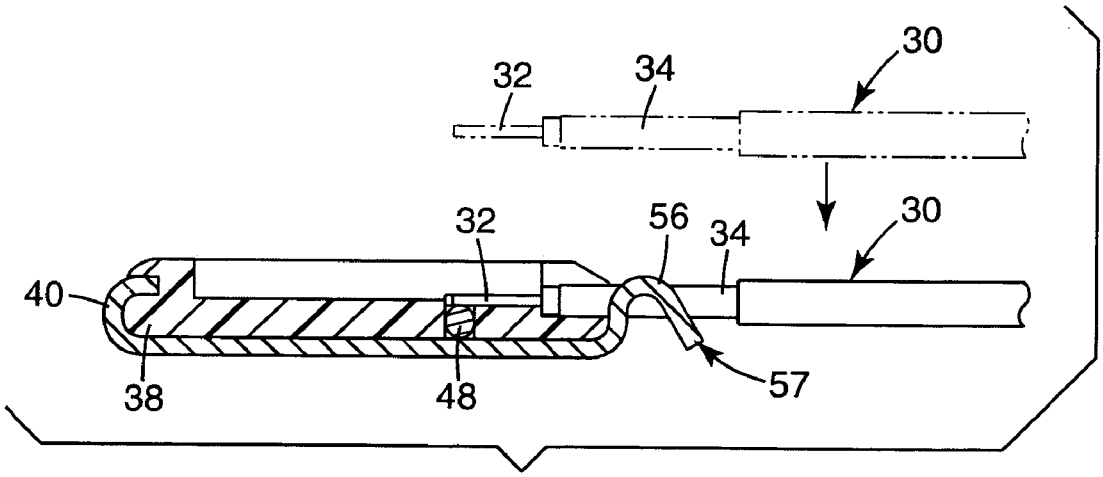

Referring now to FIG. 2C, after conductive shield member 40 is secured to connector body 38, prepared cables 30 (having portions of their signal conductors 32 and ground conductors 34 exposed) are individually or gang-loaded into the connector 22. In one embodiment, the conductive shield member 40 includes cable alignment and strain relief features which locate and retain the cables 30 in concert with assembly tooling (not shown). In one embodiment, the cable alignment and strain relief features comprise a trough-shaped portion 56 adjacent a back edge 57 of the connector 22. In one embodiment, the trough-shaped portion 56 has a series of notches or channels 58 therein (best seen in FIGS. 1 and 9). The channels 58 are positioned and shaped to receive cables 30 and properly align cables 30 with connector body 38.

Figure 2D:
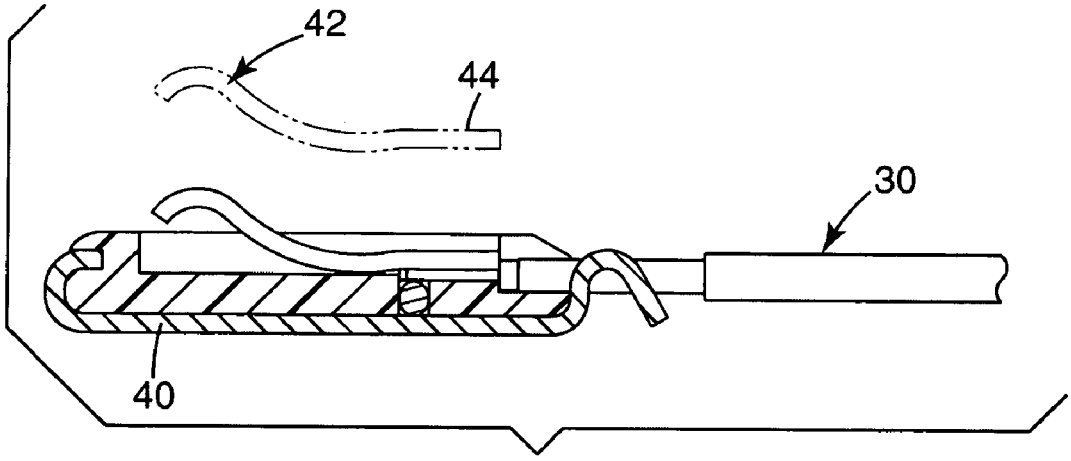

After the cables 30 are positioned in the connector 22 using the cable alignment and strain relief features, signal contacts 42 are loaded into the connector body 38 (FIG. 2D). As with cables 30, signal contacts 42 are individually or gang-loaded into connector body 38. Signal contacts 42 are temporarily maintained in position within connector body 38 by any suitable means, such as press-fit or heat-staking, for example. Terminal ends 44 of the signal contacts 42 are thus positioned in close proximity to signal conductors 32 of corresponding cables 30. Assembling the signal contacts 42 into connector body 38 after loading of cables 30 aids in forcing the signal conductors 32 of each of the cables 30 into a flat position, which aids in later reflow soldering operations, as described below.

Figure 2E:
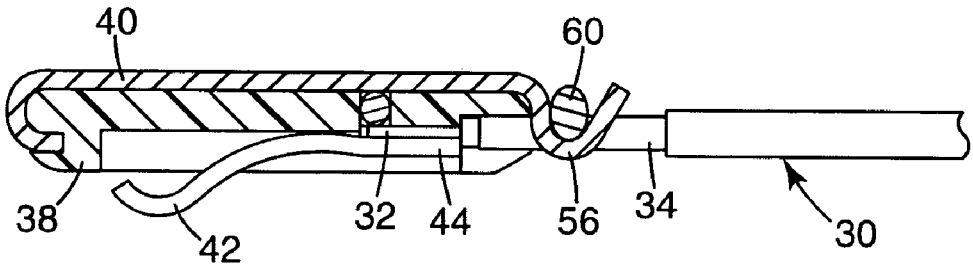
Figure 2F:
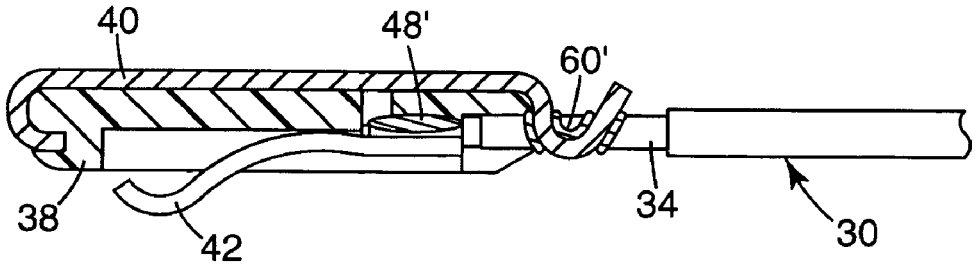

Referring now to FIGS. 2E and 2F, after cables 30 and signal contacts 42 are loaded, a solder paste or a solder preform 60 is placed in the trough-shaped portion 56 of shield 40 adjacent the exposed ground conductor 34 of the cables 30. The connector 22 with cables 30 is then reflow soldered in a single operation (FIG. 2F). During the reflow soldering process, the solder paste or pre-form 48 in the solder wells 46 flows between the terminal ends 44 of the signal contacts 42 and their respective signal conductors 32 to provide mechanical and electrical connection therebetween via solder joint 48'. Simultaneously, the solder paste or preform 60 in the trough-shaped portion 56 of shield 40 flows between the cable ground conductors 34 and the conductive shield 40 to provide mechanical and electrical connection therebetween via solder joint 60'.

In one embodiment according to the invention, the conductive shield 40 includes solder barriers positioned between adjacent solder wells 46 to prevent solder bridging between adjacent signal contacts 42 during reflow soldering. The solder barriers may be created using known means, such as nickel plating or inlays on conductive shield 40, or use of dual-material strips for the fabrication of shield 40. The solder barriers may be formed using non-wettable materials, such as Kapton film, between the solder wells 46 and the shield, bonded to the shield 40 or applied to the connector body 38 after solder paste or preforms 48 are placed into the solder wells 46. In one embodiment, solder barriers are provided on signal contacts 42 to prevent migration of solder away from the desired location during reflow soldering.

Referring again to FIG. 1, the frame 24 is configured for mounting on the printed circuit 36, and defines a space 70 for receiving the connector 22 therein. In one embodiment, when frame 24 is mounted on the printed circuit 36 the receiving space 70 defined by frame 24 encompasses one or more printed circuit contact pads 72. The frame 24 is configured to direct or guide the connector 22 into the receiving space 70 at an oblique insertion angle with respect to the plane of the printed circuit 36. In one embodiment, the frame 24 is electrically conductive and configured for connection to an electrical ground 80 of the printed circuit 36.

In the embodiment of FIG. 1, frame 24 is formed from a single flat metal blank stamping which is bent and folded to form the completed frame. Frame 24 includes a front surface mount solder leg 82 extending along the width of the frame 24, and a rear surface mount solder leg 84, also extending along the width of the frame 24. The front and rear surface mount solder legs 82, 84 act to stiffen the printed circuit 36 and thereby resist bowing of the circuit 36 away from the connector 22 when mated with the frame 24. Additional side solder legs 86 may optionally be provided. The frame 24 further includes a latch member 90 positioned adjacent a back portion 92 of the frame, which prevents the connector 22 from being dislodged rearward or upward.

Figure 6:
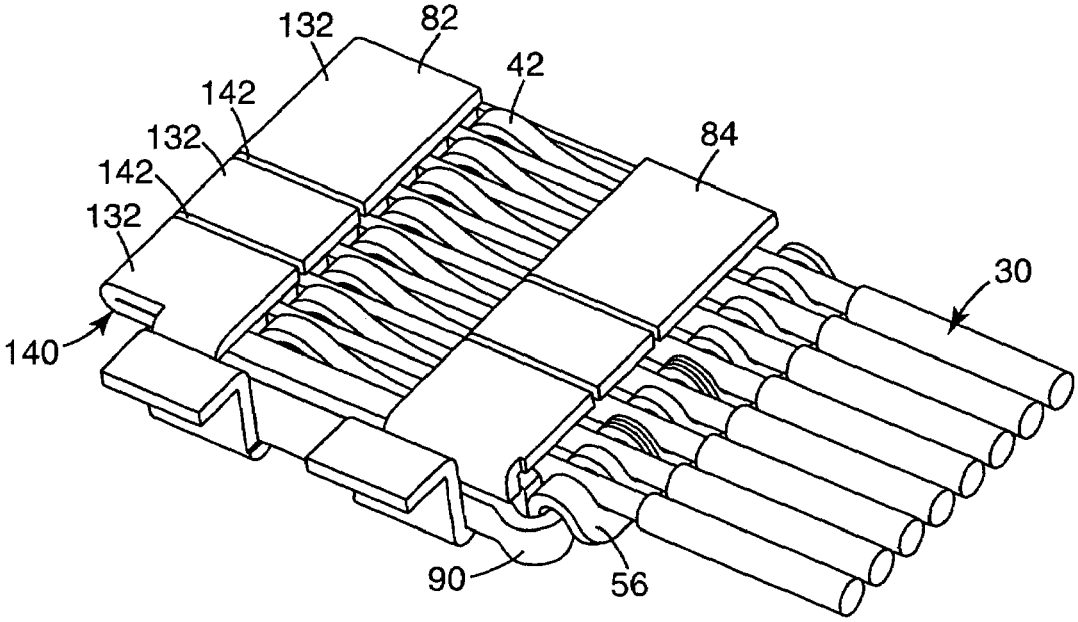
FIG. 6 is a bottom perspective view of the connector assembly of FIG. 5.

A first guide feature 94 is formed adjacent a front portion 96 of the frame 24, and a second guide feature 98 is formed adjacent back portion 92 of the frame 24. In the illustrated embodiment, the latch member 90 is configured such that the latch member 90 also functions as the second guide feature 98. The first and second guide features 94, 98 are shaped and positioned to direct the connector 22 into the receiving space 70 at an oblique insertion angle with respect to the plane of printed circuit 36. The first guide feature 94 (adjacent the front portion 96 of the frame 24) is configured to capture a front edge 59 of the connector 22 as the connector 22 is inserted into the receiving space 70 of the frame 24. In one embodiment, the first guide feature 94 forms a spring member biased toward the printed circuit 36 to aid in biasing the connector 22 against the printed circuit 36. The first guide feature 94 may be divided into a plurality of spring fingers 100, as illustrated in FIG. 1, or may alternately comprise a single spring member extending across the width of the frame 24. The second guide feature 98 (adjacent the back portion 92 of the frame 24) is configured to prevent horizontal insertion of connector 22 into frame 24. In addition to preventing horizontal engagement or disengagement with frame 24, the latch member 90 prevents unintentional oblique angle disengagement of the connector 22 from the frame 24. As best seen in FIG. 6, the end of the latch 90 enters into the trough-shaped portion 56 of shield 40 with sufficient interference to prevent accidental disengagement, while providing a low enough retentive force to allow intentional manual disengagement, typical of passive latching systems.

Figure 3A:
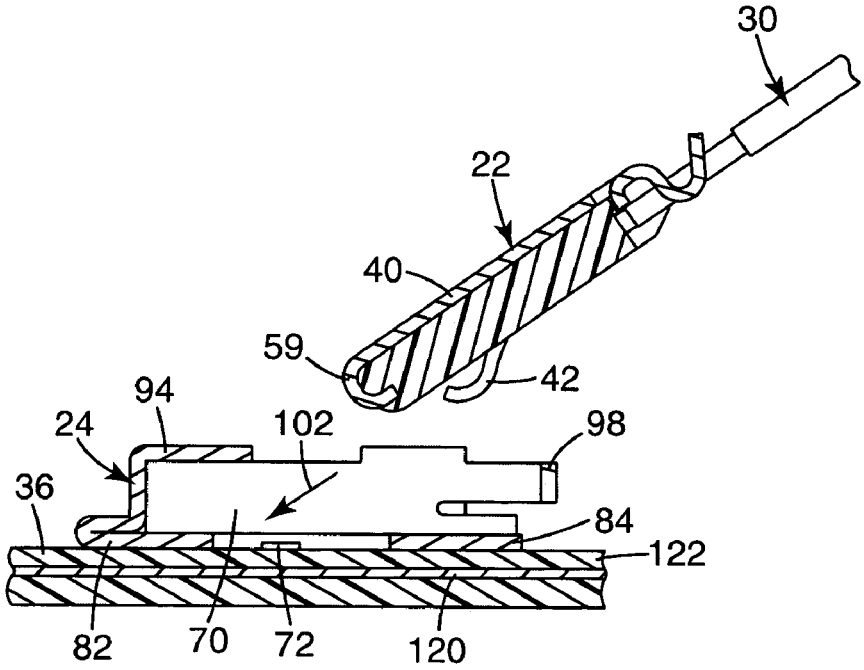
FIGS. 3A–3C are cross-sectional views illustrating insertion of the connector into the frame.
Figure 3B:
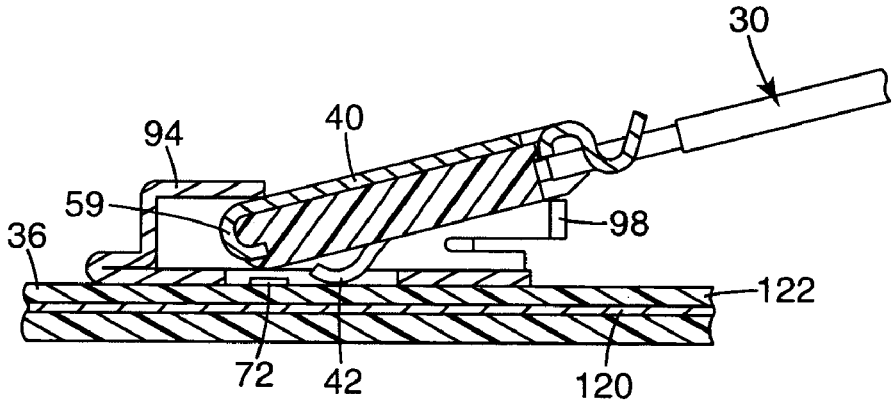
Figure 3C:
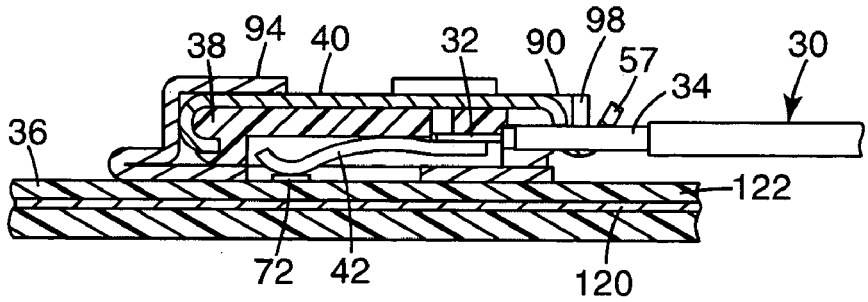

Mating between connector 22 and frame 24 is illustrated in FIGS. 3A–3C. In FIG. 3A, connector 22 is positioned adjacent frame 24 at an oblique angle with respect to printed circuit 36. The oblique angle mating of the connector 22 and frame 24 permits the frame 24 to be mounted away from an edge of the printed circuit 36, without requiring space on the printed circuit 36 that must be kept free of surface-mounted components to allow engagement and disengagement of the connector. Connector 22 is prevented from vertical insertion into frame 24 (in a direction generally orthogonal to the plane of the printed circuit 36) by first guide feature 94. Connector 22 is prevented from horizontal insertion into frame 24 (in a direction generally parallel with the plane of the printed circuit 36) by second guide feature 98. As connector 22 is directed into the receiving space 70 in the direction of arrow 102, the front edge 59 of connector 22 is captured by the first guide feature 94 of the frame 24 (FIG. 3B). As connector 22 continues to move into the frame 24, a wiping action is provided between shield member 40 of connector 22 and the first guide feature 94, assuring good electrical contact therebetween and connecting the shield member 40 to the ground 80 (best seen in FIG. 1) of the printed circuit 36. Subsequently, with further movement of connector 22 into frame 24, a wiping action is provided between the signal contacts 42 of the connector 22 and the contact pads 72 on the printed circuit 36, assuring good electrical contact therebetween. The sequential engagement of the ground elements (shield member 40 and frame 24) before the signal elements (signal contacts 42 and contact pads 72) is beneficial, as any static discharge between the connector 22 and the frame 24 is harmlessly routed to ground. As connector 22 is fully inserted into frame 24 and clears the second guide feature 98, the back edge 57 of connector 22 is rotated toward the printed circuit 36. Connector 22 is then maintained in a mated configuration with frame 24 by one or more latch members 90 (FIG. 3C). In one embodiment according to the invention, the connector 22 and frame 24 have a mated height of less than about 1.2 mm.

Figure 4:
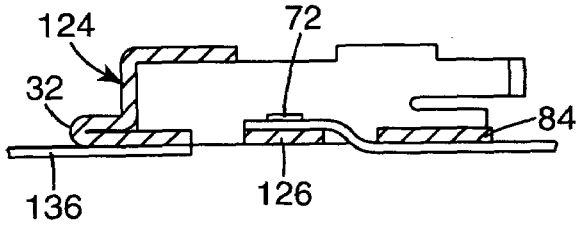
FIG. 4 is a cross-sectional view of another embodiment of a frame according to the invention, where the printed circuit is a flexible circuit.

In one embodiment according to the invention, the printed circuit is a flexible circuit. In FIG. 4, a flexible printed circuit 136 is illustrated as used with a frame 124. Frame 124 is constructed in a manner like that described above with respect to frame 24, and further includes a contact support member 126 adapted to extend under the flexible printed circuit 136 and maintain the contact pads 72 of the flexible printed circuit 136 in close relationship to the signal contacts 42 of the connector 22. In the illustrated embodiment, the flexible printed circuit 136 is cut to provide a tongue that extends over support member 126. In some embodiments, the flexible printed circuit 136 may in turn be mounted on a rigid substrate, including but not limited to a printed circuit board.

In one embodiment according to the invention, the printed circuit 36 includes a ground plane 120 extending under substantially all of the receiving space 70 defined by the frame 24 (illustrated in FIGS. 3A–3C). The ground plane 120 is isolated from the printed circuit contact pads 72 by a layer 122 of dielectric material. When the connector 22 is mated with the frame 24, the signal contacts 42, shield member 40, printed circuit ground plane 120, dielectric connector body 38, and printed circuit dielectric material layer 122 form a controlled-impedance structure for the signal path as it extends through connector assembly 20.

Figure 5:
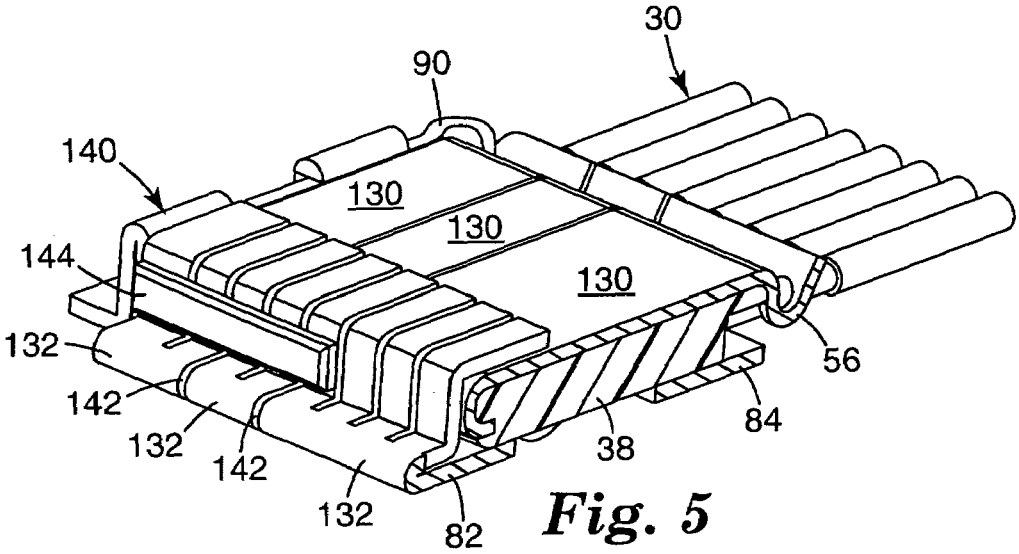
FIG. 5 is a top perspective view of another embodiment of a connector assembly according to the invention, the connector and frame having isolated ground segments.

In another embodiment of the connector assembly 20, and as illustrated in FIG. 5, the conductive shield member 40 is divided into two or more isolated ground segments 130. The isolated ground segments 130 may correspond to groups of cables for which it is desirable to have separate grounds to avoid interference. For example, power cables, signal cables, and antenna cables may each have separate and isolated electrical grounds. The frame thus also preferably provides conductive portions 132 that are divided corresponding to the isolated ground segments 130 of the conductive shield 40, so that each of the isolated grounds segments 130 can be separately routed to the printed circuit 36.

Figure 7:
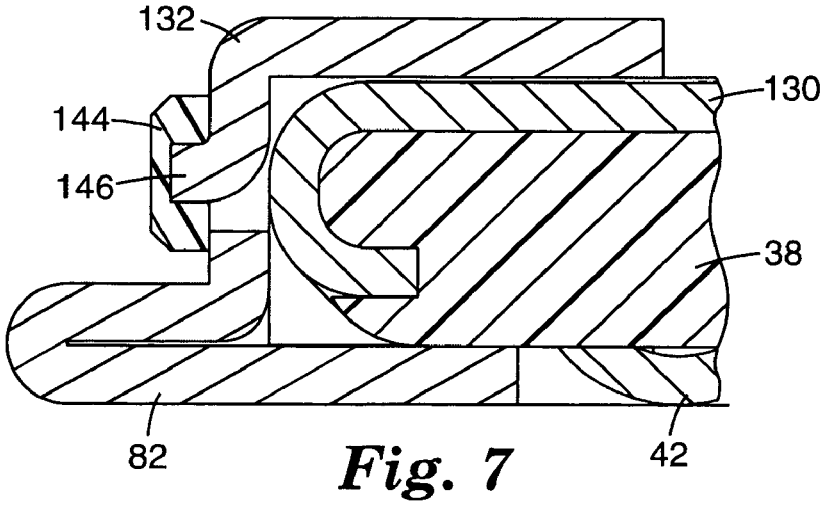
FIG. 7 is a greatly enlarged cross-sectional illustration of a portion of the frame of FIG. 5, illustrating one method of joining ground segments of the frame.

Referring to FIGS. 5 and 6, in one embodiment a frame 140 comprises a plurality of conductive portions 132 separated from each other by dielectric material 142. In one embodiment, dielectric material 142 is air. In the illustrated embodiment, the conductive portions 132 are joined together by a dielectric joining member 144 to form the frame 140. In the illustrated embodiment, the joining member 144 is press-fit or snap fit over protrusions 146 extending from the conductive portions 132 (FIG. 7). However, conductive portions 132 may be joined to form the frame 140 in any suitable manner. For example, in other embodiments the conductive portions 132 may be secured to a dielectric joining member 144 by means such as over-molding, press-fit, snap-fit, adhesive bonding, or by using attaching hardware such as clips, screws, rivets or the like.

Figure 8:
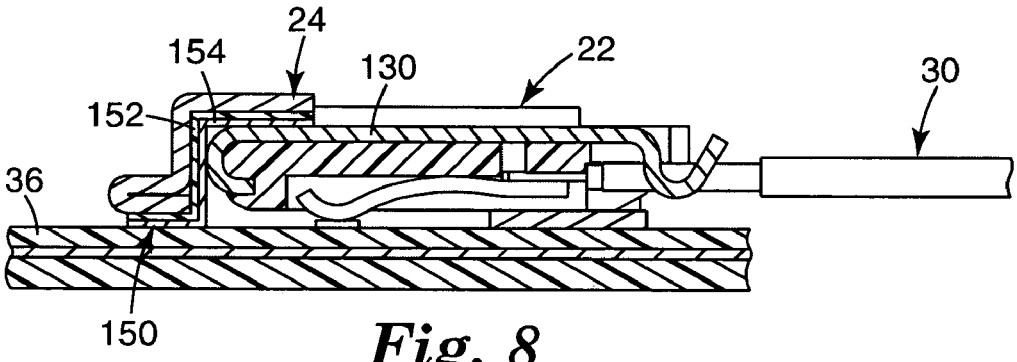
FIG. 8 is a cross-sectional view of another embodiment of a connector assembly according to the invention, the connector and frame having isolated ground segments.

Referring now to FIG. 8, in another embodiment according to the invention, the isolated ground segments 130 of the connector 22 are routed to isolated grounds of the printed circuit 36 by another circuit 150 positioned within the receiving space 70 of the frame 24. In one embodiment, the circuit 150 within the receiving space 70 of the frame 24 is a flexible circuit. The insulative material 152 of the circuit 150 electrically isolates the conductive portions 154 of the circuit from the conductive frame 24.

In each of the embodiments described herein, all polymer parts are molded from suitable thermoplastic material having the desired mechanical and electrical properties for the intended application. The conductive metal parts are made from, for example, plated copper alloy material, although other suitable materials will be recognized by those skilled in the art. The connector assembly materials, geometry and dimensions are all designed to maintain a specified impedance throughout the assembly.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A connector assembly comprising:

a connector portion comprising:

a connector body configured for receiving a plurality of cables, the cables each of the type having a signal conductor and a ground conductor;

a conductive shield member on a top surface of the connector body, the shield member configured for connection to ground conductors of the plurality of cables;

a plurality of signal contacts extending from a bottom surface of the connector body, each signal contact having a terminal end configured for connection to signal conductors of the plurality of cables; and a frame for mounting on a printed circuit, the frame including at least one conductive portion configured for connection to a ground of the printed circuit, the frame defining a space for receiving the connector portion therein, and configured to direct the connector portion into the receiving space at an oblique insertion angle with respect to the printed circuit such that the signal contacts extending from the bottom surface of the connector body engage contact pads on the printed circuit.

2. The connector assembly of claim 1, wherein the frame is configured to provide a wiping action between the signal contacts of the connector portion and contact pads of the printed circuit when the connector portion is inserted into the frame.

3. The connector assembly of claim 2, wherein the frame is shaped to provide a wiping action between the conductive shield member of the connector portion and the conductive portion of the frame when the connector portion is inserted into the frame.

4. The connector assembly of claim 1, wherein the conductive shield is divided into at least two isolated ground segments.

5. The connector assembly of claim 4, wherein the conductive portion of the frame is divided into isolated ground segments corresponding to the at least two isolated ground segments of the conductive shield.

6. The connector assembly of claim 1, wherein the conductive portion of the frame comprises a printed circuit.

7. The connector assembly of claim 6, wherein the printed circuit is a flexible circuit.

8. The connector assembly of claim 1, wherein the frame comprises at least one insulative portion.

9. The connector assembly of claim 1, wherein the connector body of the connector portion includes a plurality of solder wells positioned adjacent the terminal end of each of the plurality of signal contacts.

10. The connector assembly of claim 9, further comprising one of a solder preform and solder paste retained within the solder wells of the insulative connector body.

11. The connector assembly of claim 9, wherein the conductive shield includes solder barriers positioned between adjacent solder wells.

12. The connector assembly of claim 1, wherein the conductive shield member of the connector portion, the conductive portion of the frame, and a ground plane of the printed circuit are electrically connected with each other, and cooperate to provide electrical shielding on all sides of the connector assembly.

13. The connector assembly of claim 1, wherein the connector body is formed from an insulative material.

14. The connector assembly of claim 1, wherein the frame is formed from a conductive material.

15. The connector assembly of claim 1, wherein the frame is formed from metal.

16. The connector assembly of claim 15, wherein the frame is fabricated from a single piece of sheet metal.

17. The connector assembly of claim 1, wherein the frame includes an insertion guide configured to direct the connector portion into the receiving space at an oblique insertion angle with respect to the printed circuit.

18. The connector assembly of claim 1, wherein the cables are coaxial cables.

19. The connector assembly of claim 1, wherein the cables are twinaxial cables.

20. The connector assembly of claim 1, wherein the connector and frame have a mated height of less than about 1.2 millimeters.

21. A connector assembly comprising:

a connector coupled to a plurality of cables, the connector comprising:

a dielectric connector body;

a conductive shield member covering a top surface of the dielectric connector body, the conductive shield member electrically connected to shields of the plurality of cables; and a plurality of signal contacts adjacent a bottom surface of the dielectric connector body, the signal contacts connected to signal conductors of the plurality of cables;

a conductive frame mounted on a printed circuit and electrically connected to a ground of the printed circuit, wherein the frame defines a connector receiving space having a plurality of printed circuit contact pads therein, the frame having a first guide member adjacent a front portion thereof and a second guide member adjacent a back portion thereof, the first and second guide members cooperating to direct the connector into the receiving space at an oblique insertion angle with respect to the printed circuit such that the signal contacts of the connector contact the printed circuit contact pads with a wiping action.

22. The connector assembly of claim 21, wherein the first guide member adjacent the front edge of the conductive frame is configured to capture a front edge of the connector as the connector is inserted into the receiving space of the frame.

23. The connector assembly of claim 22, wherein the first guide member is configured to make electrical contact with the conductive shield member of the connector.

24. The connector assembly of claim 22, wherein the second guide member forms a spring member biased toward the printed circuit.

25. The connector assembly of claim 21, wherein the frame further comprises a latch member for retaining the connector within the receiving space of the frame.

26. The connector assembly of claim 25, wherein the latch member is positioned adjacent a back edge of the connector.

27. The connector assembly of claim 21, wherein the printed circuit is rigid.

28. The connector assembly of claim 21, wherein the printed circuit is flexible.

29. The connector assembly of claim 28, wherein the frame further comprises a support member extending under the contact pads of the flexible printed circuit.

30. The connector assembly of claim 21, wherein the frame is fabricated from a single piece of sheet metal.

31. The connector assembly of claim 21, wherein the connector and frame have a mated height of less than about 1.2 millimeters.

32. The connector assembly of claim 21, wherein the frame is mounted away from an edge of the printed circuit.

33. The connector assembly of claim 21, wherein the conductive shield member of the connector further comprises a cable alignment and strain relief portion adjacent a back edge of the connector.

34. The connector assembly of claim 33, wherein the cable alignment and strain relief portion is configured to retain one of a solder preform and solder paste.

35. The connector assembly of claim 21, wherein the conductive shield is divided into at least two isolated ground segments.

36. The connector assembly of claim 35, wherein the isolated ground segments are routed to the ground of the printed circuit by a circuit positioned within the receiving space of the frame.

37. The connector assembly of claim 36, wherein the circuit positioned within the receiving space of the frame is a flexible circuit.

38. The connector assembly of claim 21, wherein the printed circuit includes a ground plane extending under substantially all of the receiving space defined by the frame and isolated from the printed circuit contact pads by a dielectric material.

39. The connector assembly of claim 38, wherein the signal contacts, shield member, printed circuit ground plane, dielectric connector body and printed circuit dielectric material form a controlled impedance stripline structure when the connector and frame are in a mated condition.

* * * * *